United States Patent [19]

Soboul et al.

[11] Patent Number: 4,736,079

[45] Date of Patent: Apr. 5, 1988

[54] PUFFER TYPE ELECTRICAL CIRCUIT BREAKER HAVING A HIGH DIELECTRIC WITHSTAND

[75] Inventors: Raymond Soboul, Autrans; Gérard Menou, Seyssinet, both of France

[73] Assignee: Merlin Gerin, Grenoble Cedex, France

[21] Appl. No.: 28,723

[22] Filed: Mar. 23, 1987

[30] Foreign Application Priority Data

Apr. 3, 1986 [FR] France ..... 86 05027

[51] Int. Cl.[4] ..... H01H 33/88; H01H 33/12

[52] U.S. Cl. ..... 200/148 A; 200/146 R

[58] Field of Search ..... 200/148 A, 146 R

[56] References Cited

U.S. PATENT DOCUMENTS 3,257,532 6/1966 Lerch ..... 200/148 A 4,309,581 1/1982 Macaire et al. ..... 200/148 A 4,529,853 7/1985 Bouilliez ..... 200/146 R

*Primary Examiner*—Robert S. Macon

*Attorney, Agent, or Firm*—Parkhurst & Oliff

[57] ABSTRACT

The invention relates to improving the dielectric withstand of a puffer circuit breaker having a main circuit arranged side by side with an arcing circuit inside a sealed insulating casing filled with an insulating gas SF6.

The disconnection area arranged between the main contacts when the main circuit opens is located facing the breaking gap between the arcing contacts. The fixed main contact and the fixed arcing contact are at the potential of the upper terminal, being located at appreciably the same level on either side of the longitudinal axis of the casing.

3 Claims, 2 Drawing Sheets

PUFFER TYPE ELECTRICAL CIRCUIT BREAKER HAVING A HIGH DIELECTRIC WITHSTAND

BACKGROUND OF THE INVENTION

The invention relates to a puffer type electrical circuit breaker having a sealed casing made of moulded insulating material, filled with an insulating gas with high dielectric strength, notably sulphur hexafluoride, and comprising:

a pair of connection terminals passing through the wall of the casing, a main circuit for the rated current to flow through having a fixed main contact and a movable main contact, an auxiliary shunting circuit of the main circuit for breaking the current, and having a fixed arcing contact and a movable arcing contact, arranged in the same casing and the same gas as the main contacts, said main circuit being connected directly to the connection terminals, inside the casing extending along an adjacent trajectory transversely offset from and being shorter than that of the auxiliary circuit, and a circuit breaker operating mechanism designed to separate the main contacts before the arcing contacts open.

A state of the art circuit breaker of the kind mentioned is described in French Pat. No. 2,441,916 and European Pat. No. 11,542 filed by the applicant. The insulating casing of the circuit breaker is oblong and is subdivided by a horizontal internal wall into two compartments superposed along the longitudinal axis. The main contacts separation zone is arranged in the lower compartment, whereas the breaking gap between the arcing contacts is located in the upper compartment. It can be noted in the middle area of the casing that the fixed main contact connection system is at the potential of the upper terminal, whereas the laterally juxtaposed movable arcing contact is at the potential of the lower terminal. The difference in potential causes a strong electrical field in this area, liable to affect the electrical insulation of the circuit breaker according to the value of the rated voltage used. The longitudinal offset of the main circuit and arcing circuit separation areas limites the performances and dielectric withstand of a circuit breaker of this kind.

The object of the invention consists in improving the dielectric withstand of a puffer circuit breaker having the main circuit and the arcing circuit arranged side by side inside the casing.

SUMMARY OF THE INVENTION

The circuit breaker according to the invention is characterized by the fact that the disconnection area arranged between the main contacts when the main circuit opens is located facing the breaking gap situated between the arcing contacts when the auxiliary circuit opens, and that the fixed main contact and the fixed arcing contact are at the potential of one of the terminals, being located at appreciably the same level on either side of the longitudinal axis of the casing.

Such an arrangement of the active parts inside the casing improves the dielectric withstand of the circuit breaker, as the contacts located facing one another in the transverse direction are at the same polarities.

An insulating shield can be fitted longitudinally between the breaking gap and the disconnection area.

According to one embodiment of the invention, the circuit breaker is equipped with a puffer device having an insulating gas compression piston cylinder assembly, and a puffer nozzle coaxially surrounding the breaking gap to ensure blow-out of the arc when the auxiliary circuit opens. The cylinder of the puffer device constitutes said insulating shield between the respective contacts of the main circuit and the auxiliary circuit, the assembly being arranged in a first compartment of the casing, separated from the second adjacent compartment by a fixed intermediate wall acting as support for said cylinder.

BRIEF DESCRIPTION OF THE DRAWINGS

Other advantages and characteristics will become more clearly apparent from the following description of an embodiment of the invention, given as a non-limiting example only, and represented in the accompanying drawings, in which.

DESCRIPTION OF THE PREFERRED EMBODIMENT

Figure 1:
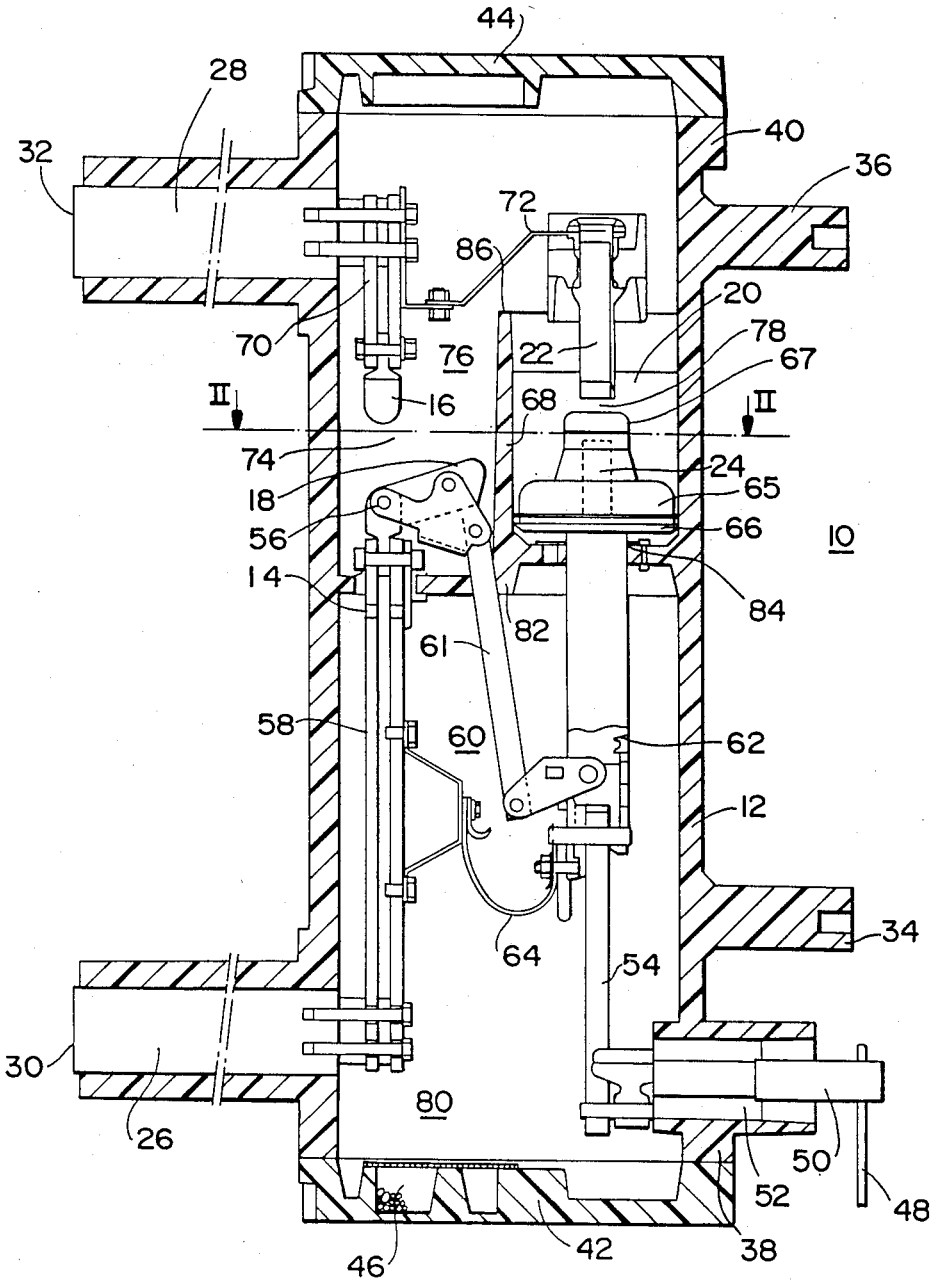
FIG. 1 is a schematic axial section view of a circuit breaker pole according to the invention, the contacts being represented in the open position.
Figure 2:
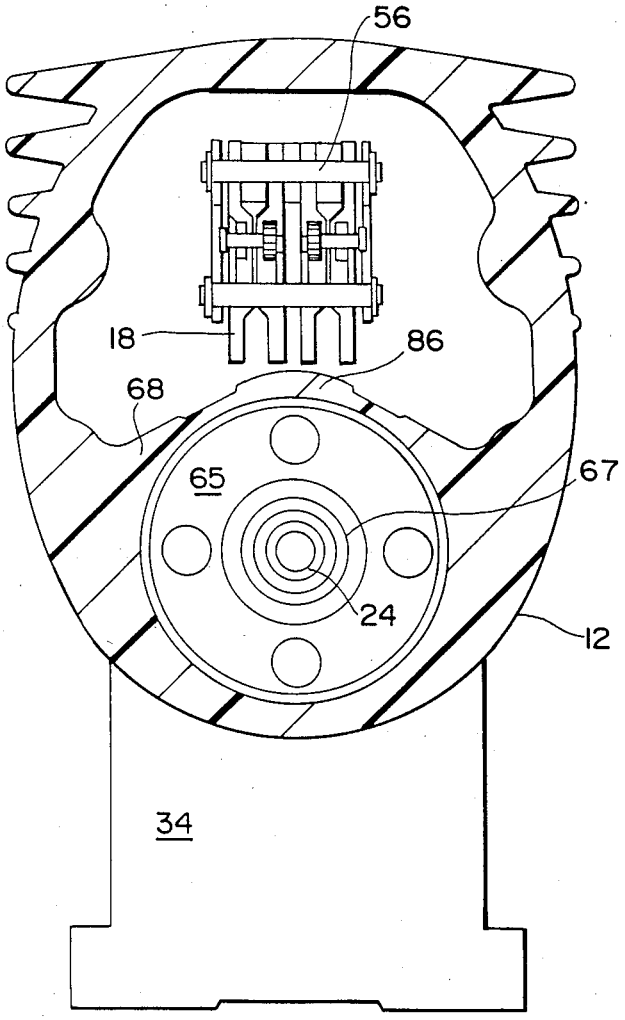
FIG. 2 is a cross-sectional view along line II—II of figure 1, on an enlarged scale.

In the figures, a pole of a puffer type electrical circuit breaker 10 is housed in a sealed casing 12 of moulded insulating material, filled with an electronegative insulating gas of high dielectric strength, notably sulphur hexafluoride. The oblong casing 12, made of epoxy resin, houses a main circuit 14 for the rated current to flow through having a pair of main contacts 16, 18, one of which is movable 18, and an auxiliary shunting circuit 20 of the main circuit 14 having a pair of arcing contacts 22, 24, one of which is movable 24. A pair of bushings 26, 28, offset in relation to one another in the longitudinal direction, pass radially through the wall of the casing 12 to constitute an input terminal 30 and an output terminal 32 of the circuit breaker pole 10.

Opposite the terminals 30, 32, the side wall of the insulating casing 12 comprises a pair of fixing studs 34, 36 designed to mechanically secure the circuit breaker 10 to an electrically grounded metal support. The studs 34, 36 are cast with the insulating casing 12, in such a way as to protrude out from the side wall situated opposite the bushings 26, 28.

The opposing open ends 38, 40 of the casing 12 are respectively blanded off by means of a lower cover 42 and an upper cover 44. A molecular sieve 46 is housed inside the casing 12 in a cavity of the lower cover 42.

An external operating mechanism (not shown) is mechanically coupled to a crank-handle 48 keyed onto a rotary shaft 50 passing through an orifice of the casing 12 with a dynamic sealing system 52 interposed. Inside the casing 12, the shaft 50 is articulated on an insulating transmission rod 54 designed to drive the moving assembly of the circuit breakerpole 10. The orifice through which the rotary shaft 50 passes is located between the fixing stud 34 and the lower end 38 of the casing 12.

The movable main contact 18 of the main circuit 14 is pivotally mounted on a spindle 56 supported by a first connecting bar 58 connected to the lower bushing 26. An intermediate transmission system 60 with a lever 61 mechanically connects the movable main contact 18 to an operating rod 62 movable in translation, having one end articulated on the insulating transmission rod 54, and an opposite end supporting the movable arcing contact 24. The rod 62 is conducting and is electrically connected to the lower bushing 26 by a flexible link conductor 64. When the shaft 50 rotates, the transmission system 60 transforms the straight-line movement of the rod 62 into a pivoting movement of the movable main contact 18, the assembly being arranged to cause separation of the main contacts 16, 18 before separation by the arcing contacts 22, 24. The pivoting movement of the movable main contact 18 is thus derived from the sliding movement of the operating rod 62 of the movable arcing contact 24.

A puffer device 65 with gas compression piston 66 and cylinder 68 is associated with the pair of arcing contacts 22, 24, and is actuated when the operating rod 62 moves to cause the arc drawn when the arcing contacts 22, 24 separate to be blown out pneumatically. The movable piston 66 is secured to the rod 62 and supports a puffer nozzle 67 coaxially surrounding the arcing contacts 22, 24.

The fixed main contact 16 is supported by a second connecting bar 70 to the upper bushing 28. the fixed arcing contact is also connected to the upper bushing 28 by means of a connection 72. Inside the casing 12, the main circuit 14 is arranged as a disconnector connected directly to the bushings 26, 28 extending along a longitudinal trajectory directly adjacent and shorter than that of the transversely offset auxiliary circuit 20.

Operation of a puffer circuit breaker of this kind is similar to that described in French Pat. No. 2,441,916 and European Pat. No. 11,549 filed by the applicant.

According to the invention, the disconnection area 74 between the fixed 16 and movable main contacts 18 of the main circuit 14 is located in the upper compartment 76 of the casing 12, opposite the breaking gap 78 and the puffer device 65 of the auxiliary circuit 20. The fixed main contact 16 is at appreciably the same level as the adjacent fixed arcing contact 22, and the pivoting main contact 18 is laterally separated from the puffer device 65 by the insulating wall of the cylinder 68. The upper compartment 76 is separated from the lower compartment 80 by an intermediate insulating wall 82 supporting the cylinder 68. The fixed wall 82 extends parallel to the covers 42, 44, and comprises an aperture 84 through which the sliding rod 62 passes. The cylinder 68 is positioned in the upper compartment 76, and its end 86 can be extended upwards, beyond the level of the fixed contacts 16, 22, in such a way as to form a fixed insulating shield extending in proximity to the mid-plane between the breaking gap 78 and the disconnection area 74.

The fixed main contact 16 and the fixed arcing contact 22 are at the potential of the upper terminal 32 and constitute two active parts of the same polarity, disposed facing one another. The same is true for the movable main contact 18 and the movable arcing contact 24, which are both at the potential of the lower terminal 30. This arrangement of the active parts inside the upper compartment 76 of the insulating casing 12 improves the dielectric withstand of the circuit breaker, and avoids any internal flashover up to rated voltages in the order of 40 kV. The conducting rod 62 and the first connecting bar 58 extend parallel in the lower compartment 80 on either side of the mid-plane, and are at the potential of the lower terminal 30.

We claim:

1. A puffer electrical circuit breaker having a sealed casing made of moulded insulating material, filled with an insulating gas with high dielectric strength, notably sulphur hexafluoride, and comprising:

a pair of first and second connection terminals passing through a wall of the casing, a main circuit for a rated current to flow through having a fixed main contact and a movable main contact, an auxiliary shunting circuit of the main circuit for breaking the current, and having a fixed arcing contact and a movable arcing contact, arranged in the same casing and the same gas as the main contacts, said main circuit being connected directly to the connection terminals, inside the casing extending along an adjacent trajectory transversely offset from and being shorter than that of the auxiliary circuit, a circuit breaker operating mechanism designed to separate the main contacts before the arcing contacts open, a fixed intermediate wall subdividing the casing into a first upper compartment and a second lower compartment along a longitudinal axis of the casing, a disconnection area arranged in the first compartment between the main contacts when the main circuit opens, a breaking gap situated in the first compartment between the arcing contacts when the auxiliary circuit opens, the fixed main contact and the fixed arcing contact being at the potential of the first terminal, so that said disconnection area and breaking gap are located at appreciably the same level on either side of the longitudinal axis of the casing, an insulating shield interposed in the first compartment between the breaking gap and the disconnection area, and being fixed to said intermediate wall, a puffer device arranged in said first compartment, and having an insulating gas compression piston cylinder assembly and a puffer nozzle coaxially surrounding the breaking gap to ensure blow-out of the arc when the auxiliary circuit opens, a first connecting bar electrically connected to the second terminal and extending longitudinally for most of its length in the second compartment and passing through the intermediate wall, a spindle supported by said first connecting bar in the first compartment, the movable main contact being pivotally mounted on said spindle, and a second connecting bar connecting the fixed main contact to the first terminal, said first and second connecting bars being in alignment with each other.

2. A puffer electrical circuit breaker according to claim 1, wherein said intermediate wall and shield form a cylinder of the puffer device.

3. An electrical circuit breaker according to claim 2, wherein the movable main contact is pivotally actuated by a transmission system coupled to a sliding rod articulated on a connecting control rod, the transmission system comprising a transmission lever passing through the intermediate wall of the casing in an oblique direction in relation to the longitudinal axis.

* * * * *